US008537093B2

(12) United States Patent
Kim

(10) Patent No.: US 8,537,093 B2
(45) **Date of Patent: *Sep. 17, 2013**

(54) SOURCE DRIVER CAPABLE OF CONTROLLING SOURCE LINE DRIVING SIGNALS IN A LIQUID CRYSTAL DISPLAY DEVICE

(75) Inventor: Ki-Joon Kim, Suwon-si (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 414 days.

This patent is subject to a terminal disclaimer.

(21) Appl. No.: 12/541,236

(22) Filed: Aug. 14, 2009

(65) Prior Publication Data

US 2009/0303226 A1 Dec. 10, 2009

Related U.S. Application Data

(63) Continuation of application No. 11/255,834, filed on Oct. 21, 2005, now Pat. No. 7,592,993.

(30) Foreign Application Priority Data

Oct. 23, 2004 (KR) ..... 2004-85091

(51) Int. Cl.
*G09G 3/36* (2006.01)

(52) U.S. Cl.
USPC ..... 345/100; 345/87; 345/98; 345/204

(58) Field of Classification Search
USPC ..... 345/87, 98, 99, 100, 204
See application file for complete search history.

(56) References Cited

U.S. PATENT DOCUMENTS

| | | | | |
|---|---|---|---|---|
| 6,201,353 | B1 * | 3/2001 | Chang et al. | 315/185 S |
| 6,331,847 | B1 * | 12/2001 | Kim et al. | 345/100 |
| 2002/0067331 | A1 * | 6/2002 | Takabayashi et al. | 345/99 |
| 2003/0052851 | A1 * | 3/2003 | Yano et al. | 345/89 |
| 2004/0239602 | A1 * | 12/2004 | Kim et al. | 345/87 |
| 2004/0263466 | A1 * | 12/2004 | Song et al. | 345/100 |
| 2005/0151714 | A1 * | 7/2005 | Hirama | 345/100 |

* cited by examiner

*Primary Examiner* — Amare Mengistu
*Assistant Examiner* — Koosha Sharifi-Tafreshi
(74) *Attorney, Agent, or Firm* — F. Chau & Associates, LLC

(57) ABSTRACT

There is provided a source driver capable of controlling the timing of source line driving signals in a liquid crystal display device. The source driver includes a plurality of output circuits, each output circuit including an output buffer and a switch. The output buffer amplifies an analog image signal, and the switch outputs the amplified analog image signal as a source line driving signal in response to a control signal. The source driver further comprises a control circuit for generating the control signal, the control circuit comprising: a delay circuit delaying a switch signal and generating a delayed switch signal; and a multiplexer selecting one of the switch signal and the delayed switch signal in response to a selection signal and outputting the selected signal as the control signal.

29 Claims, 6 Drawing Sheets

SOURCE DRIVER CAPABLE OF CONTROLLING SOURCE LINE DRIVING SIGNALS IN A LIQUID CRYSTAL DISPLAY DEVICE

CROSS-REFERENCE TO RELATED APPLICATION

This application is a continuation of U.S. patent application Ser. No. 11/255,834, filed Oct. 21, 2005, now U.S. Pat. No. 7,592,993 which claims the priority under 35 U.S.C. §119 to Korean Patent Application No. 10-2004-85091, filed on Oct. 23, 2004, in the Korean Intellectual Property Office, the disclosures of which are incorporated by reference herein in their entirety.

TECHNICAL FIELD

The present invention relates to a thin film transistor liquid crystal display device, and more particularly, to a source driver capable of controlling the timing of source line driving signals in a liquid crystal display device.

DISCUSSION OF THE RELATED ART

Liquid crystal display devices are typically used in notebook computers, desktop computer monitors and televisions, etc. Generally, a liquid crystal display device includes a gate driver for driving gate lines of a panel and a source driver for driving source lines of the panel.

FIG. 1 is a block diagram of a conventional line driver 10, which drives a source line, and includes a level shifter 12, a digital-to-analog converter (DAC) 14, an output buffer 16, and a switch 18.

The level shifter 12 raises the voltage level of a digital image signal D_DATA and the DAC 14 converts a digital image signal output from the level shifter 12 to an analog image signal IN. The analog image signal IN has a gray level voltage and is also called an RGB data signal.

The output buffer 16 amplifies the analog image signal IN and the switch 18 outputs the amplified analog image signal IN as a source line driving signal OUT in response to the activation of a control signal SW. The output buffer 16 and the switch 18 constitute an output circuit.

FIG. 2 is a circuit diagram of a conventional source driver 100 including a plurality of output circuits 111 through 11*n*, where n is an integer greater than 2. The output circuit shown in FIG. 1 has the same or similar structure as each of the output circuits 111 through 11*n*.

Referring to FIG. 2, the first output circuit 111 includes a first output buffer B1 and a first transmission gate or switch S1. The first output buffer B1 can be implemented by an operational amplifier with a voltage follower structure. The first output buffer B1 amplifies a first analog image signal IN1 and outputs a first internal image signal INT1. The first transmission gate S1 outputs the first internal image signal INT1 as a first source line driving signal OUT1 in response to the activation of a control signal SW and the activation of an inverted control signal SWB. The first source line driving signal OUT1 drives a first source line of a panel of a liquid crystal display device.

Each of second through n-th output circuits 112 through 11*n* includes the same or similar components as the first output circuit 111, and therefore detailed descriptions thereof are omitted.

FIG. 3 is an exemplary timing diagram of various signals of the first output circuit 111.

Referring to FIG. 3, the first internal image signal INT1 and the first source line driving signal OUT1 change by going to a high level or a low level with respect to a common voltage VCOM. The common voltage VCOM is a voltage applied to a terminal of a liquid crystal capacitor included in a pixel of the panel of a liquid crystal display device. The common voltage VCOM may be VDD/2, where VDD is a power supply voltage.

When the first internal image signal INT1 transitions from a high level (for example, the power supply voltage VDD) to a low level (for example, a ground voltage VSS) or from the low level VSS to the high level VDD, the control signal SW is activated to a high level. Then, the first source line driving signal OUT1 is generated. Accordingly, the timing of the first source line driving signal OUT1 depends on the activation time of the control signal SW. Likewise, the timing of second through n-th source line driving signals OUT2 through OUTn depend on the activation time of the control signal SW when it is applied to the transmission gates S2 through Sn.

FIG. 4 is a timing diagram showing various timing relationships D0 through D7 of the first through n-th source line driving signals OUT1 through OUTn.

As shown in FIG. 4, when the source line driving signals OUT1 through OUTn have the timing relationship shown by D0 they are equal. When the source line driving signals OUT1 through OUTn have the timing relationship shown by D1 they increase sequentially and when the source line driving signals OUT1 through OUTn have the timing relationships shown by D2 through D7 they fluctuate by going to a high level or a low level.

Due to variations and tolerances of the materials and manufacture of a chip embodying a source driver, offsets can occur between the timing of the source line driving signals OUT1 through OUTn in the source driver chip and between source driver chips. As a result, such offsets render unstable operation of a liquid crystal display device. A need therefore exists for a source driver capable of controlling the timing of source line driving signals in a liquid crystal display device.

SUMMARY OF THE INVENTION

According to an aspect of the present invention, there is provided a source driver of a liquid crystal display device, including a plurality of output circuits, each of the output circuits comprising: an output buffer amplifying an analog image signal; and a switch outputting the amplified analog image signal as a source line driving signal whose timing is controlled, in response to the activation of a control signal.

The source driver further includes a control circuit generating the control signal, wherein the control circuit comprises: at least one delay circuit delaying a switch signal by a predetermined amount of time and generating a delayed switch signal; a multiplexer selecting one of the switch signal and the delayed switch signal in response to a selection signal and outputting the selected signal as the control signal; and an inverter inverting the control signal and generating an inverted signal of the control signal.

The predetermined amount of time is less than a predetermined value so that the source line driving signal is output by the control signal and the inverted signal of the control signal.

The switch is a transmission gate operating in response to the activation of the control signal and the activation of an inverted signal of the control signal, and the output buffer is an operational amplifier with a voltage follower structure.

According to another aspect of the present invention, there is provided a source driver of a liquid crystal display device, comprising: output circuit blocks, each including at least two output circuits, outputting source line driving signals; and control circuits generating control signals controlling timings of the source line driving signals.

Each of the output circuits comprises: an output buffer amplifying an analog image signal; and a switch outputting the amplified analog image signal as the source line driving signal in response to the activation of the control signal.

Each of the control circuits comprises: at least one delay circuit delaying a switch signal by a predetermined amount of time and generating a delayed switch signal; a multiplexer selecting one of the switch signal and the delayed switch signal in response to a selection signal and outputting the selected signal as the control signal; and an inverter inverting the control signal and generating an inverted signal of the control signal.

According to another aspect of the present invention, a method for controlling a source line driving signal in a liquid crystal display device is provided. The method comprises: amplifying, from an output buffer of a source driver, an analog image signal; delaying, at a first delay circuit of a control circuit of the source driver, a switch signal and generating, at the first delay circuit, a delayed switch signal; selecting, at a multiplexer of the control circuit, one of the switch signal and the delayed switch signal in response to a selection signal and outputting, at the multiplexer, the selected signal as a control signal; and outputting, from a switch of the source driver, the amplified analog image signal as the source line driving signal in response to the control signal.

The analog image signal is generated by a level shifter and a digital to analog converter of the liquid crystal display device. The switch signal is delayed by a first amount of time that is less than a first value so that the source line driving signal is output by the control signal and the inverted control signal. The selection signal is received through a timing controller of the liquid crystal display device or through option pins of the source driver. The delay of the switch signal sequentially increases from the first delay circuit to a second delay circuit.

BRIEF DESCRIPTION OF THE DRAWINGS

The above and other features of the present invention will become more apparent by describing in detail exemplary embodiments thereof with reference to the attached drawings in which.

DETAILED DESCRIPTION OF EXEMPLARY EMBODIMENTS

Hereinafter, embodiments of the present invention will be described in detail with reference to the appended drawings. Like reference numbers refer to like components throughout the drawings.

Figure 5:
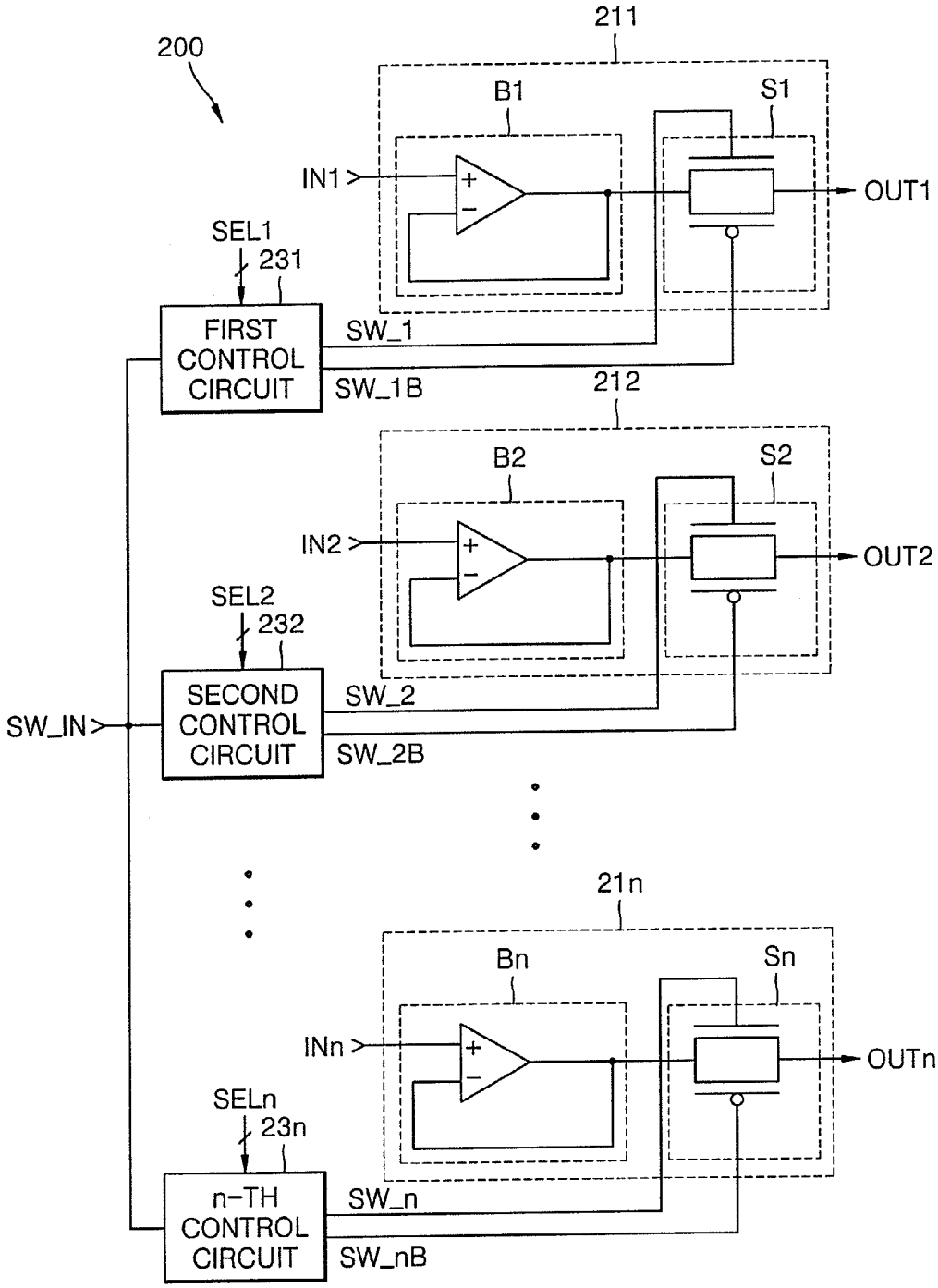
FIG. 5 is a schematic diagram of a source driver of a liquid crystal display device according to an exemplary embodiment of the present invention.

FIG. 5 is a schematic diagram of a source driver 200 of a liquid crystal display device according to an embodiment of the present invention.

Referring to FIG. 5, the source driver 200 includes first through n-th output circuits 211 through 21*n* and first through n-th control circuits 231 through 23*n* for controlling the timings of the output circuits 211 through 21*n*. Here, n is an integer greater than 2.

The first output circuit 211 includes a first output buffer B1 and a first switch S1. The first output buffer B1 can be implemented by an operational amplifier with a voltage follower structure, and the first switch S1 can be implemented by a transmission gate operating in response to a first control signal SW_1 and an inverted first control signal SW_1B.

Figure 1:
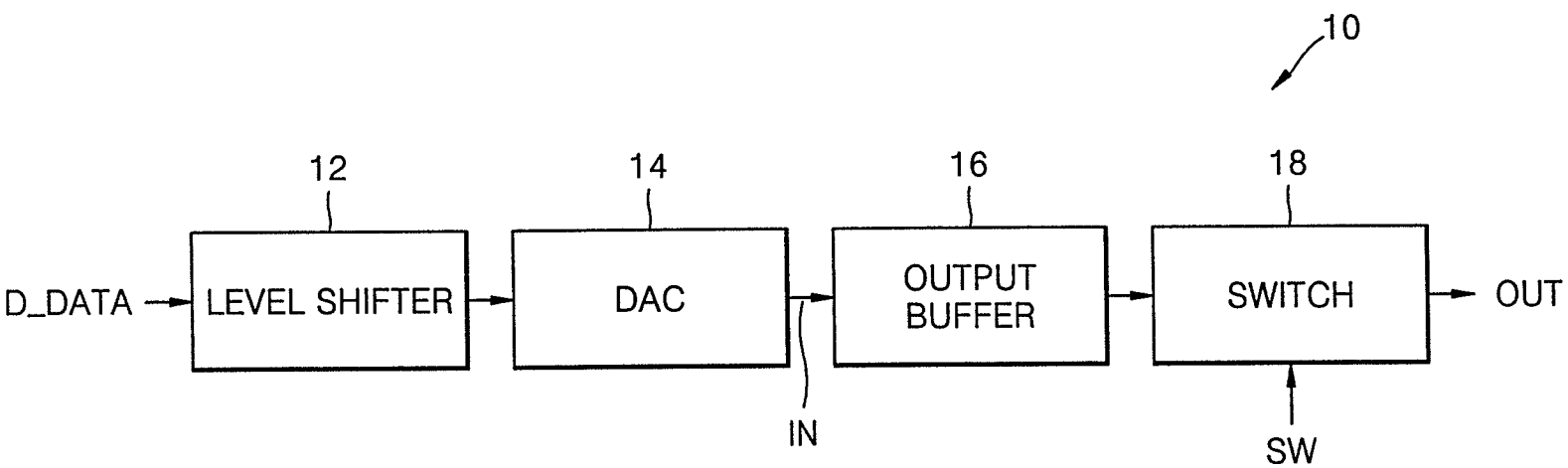
FIG. 1 (PRIOR ART)
FIG. 1 is a block diagram of a line driver included in a conventional source driver.
Figure 2:
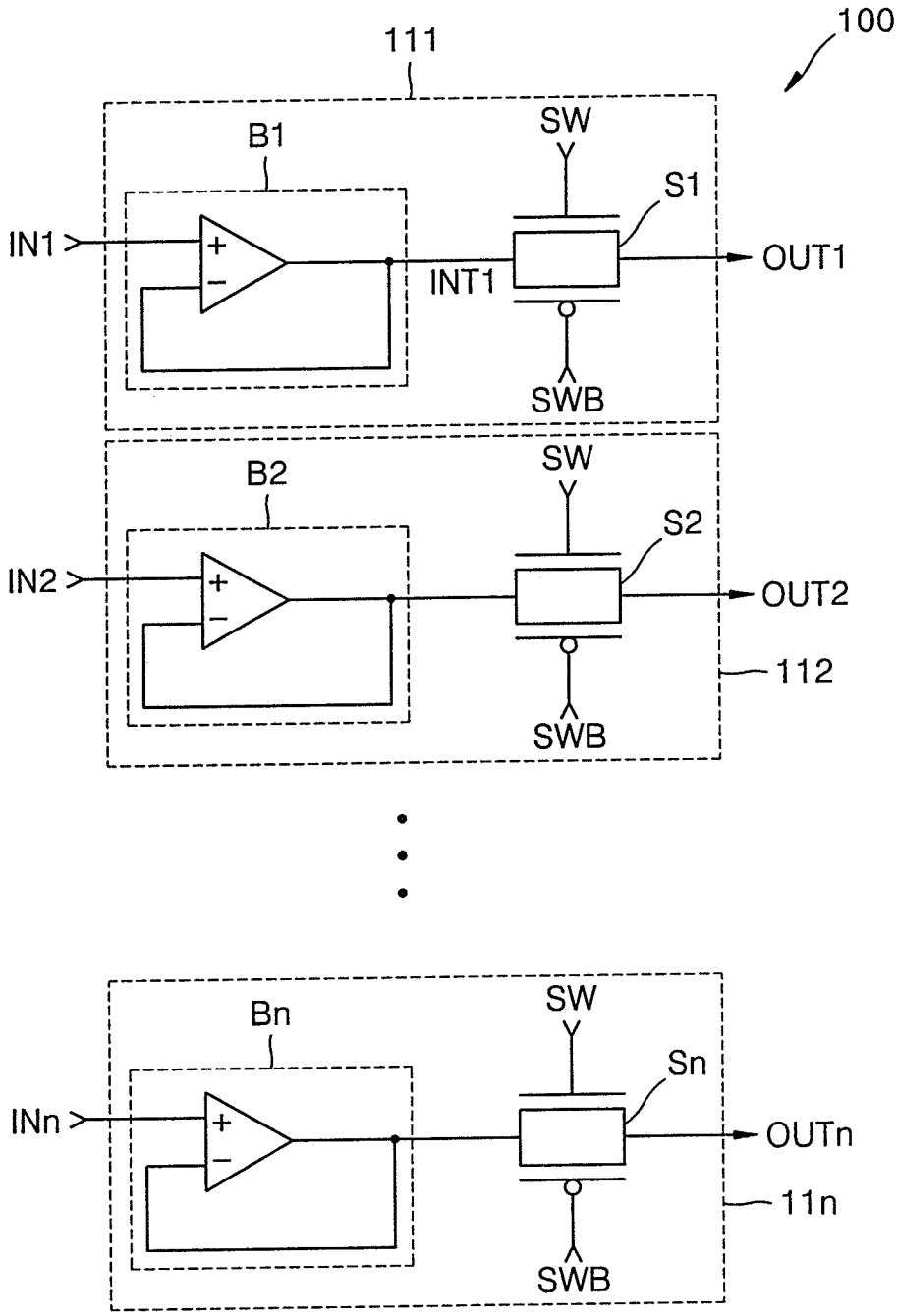
FIG. 2 (PRIOR ART)
FIG. 2 is a circuit diagram of a conventional source driver including a plurality of output circuits.
Figure 3:
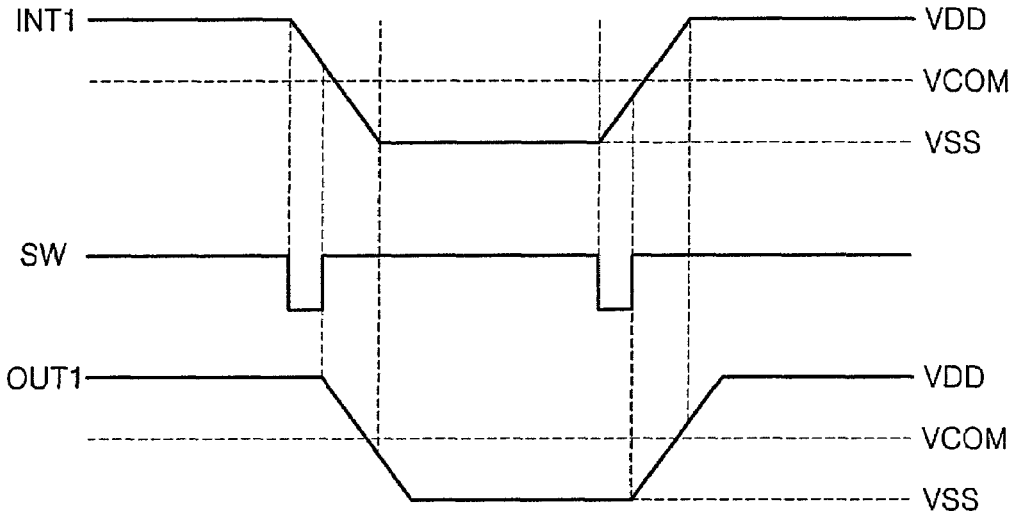
FIG. 3 (PRIOR ART)
FIG. 3 is an exemplary timing diagram of a first output circuit shown in FIG. 2.
Figure 4:
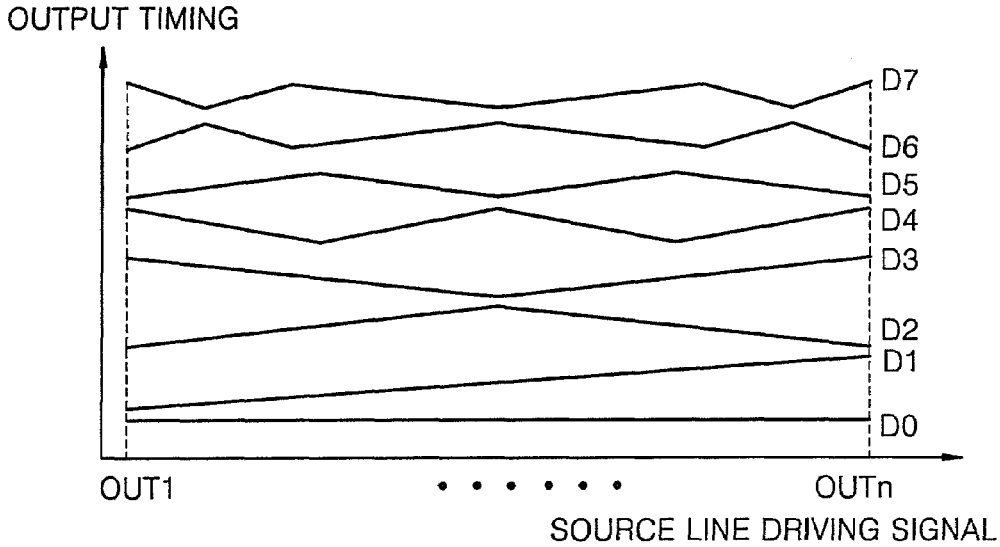
FIG. 4 (PRIOR ART)
FIG. 4 is a timing diagram showing various timing relationships of source line driving signals shown in FIG. 2.

The first output buffer B1 amplifies a first analog image signal IN1 generated by the level shifter 12 and the DAC 14 shown in FIG. 1. The first switch S1 outputs the amplified analog image signal IN1 as a first source line driving signal OUT1 in response to the activation of the first control signal SW_1 and the activation of the inverted first control signal SW_1B. In other words, the first switch S1 controls the timing of the first source line driving signal OUT1.

The first control circuit 231 delays a switch signal SW_IN, generates a plurality of delayed switch signals, selects one of the switch signal SW_IN and the delayed switch signals in response to a first selection signal SEL1, and outputs the selected signal as the first control signal SW_1 and outputs the inverted first control signal SW_1B. The switch signal SW_IN is generated by the source driver 200, and the first selection signal SEL1, which consists of a plurality of bits, and can be received through a timing controller of the liquid crystal display device or through option pins of a source driver chip.

Second through n-th output circuits 212 through 21*n* include the same or similar components [B2, S2] through [Bn, Sn] as the first output circuit 211. In addition, second through n-th control circuits 232 through 23*n* for controlling the timings of the second through n-th output circuits 212 through 21*n* perform the same or similar functions as the first control circuit 231. Accordingly, detailed descriptions of the second through n-th output circuits 212 through 21*n* and the second through n-th control circuits 232 through 23*n* are omitted.

Referring to FIG. 5, input signals of the second through n-th output circuits 212 through 21*n* are second through n-th analog image signals IN2 through INn and output signals of the second through n-th output circuits 212 through 21*n* are second through n-th source line driving signals OUT2 through OUTn. Control signals of the second through n-th control circuits 232 through 23*n* are second through n-th selection signals SEL2 through SELn and output signals of the second through n-th control circuits 232 through 23*n* are second through n-th control signals SW_2 through SW_n and inverted control signals SW_2B through SW_nB.

Figure 6:
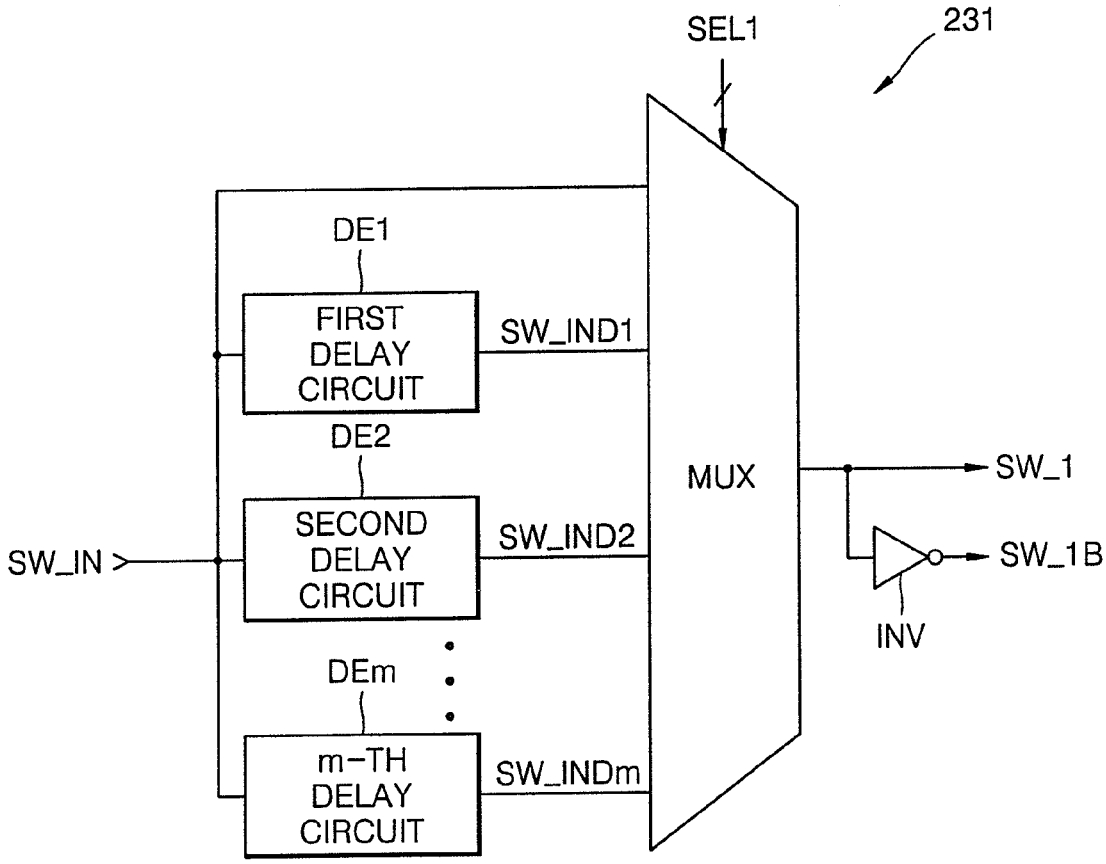
FIG. 6 is a block diagram of a first control circuit shown in FIG. 5.

FIG. 6 is a block diagram of the first control circuit 231 shown in FIG. 5.

Referring to FIG. 6, the first control circuit 231 includes first through m-th delay circuits DE1 through DEm, a multiplexer MUX, and an inverter INV.

The first through m-th delay circuits DE1 through DEm delay the switch signal SW_IN by a predetermined number of times and output delayed switch signals SW_IND1 through SW_INDm, respectively. Here, m is an integer greater than 2, which may be set according to the size of a source driver chip.

The delays of the first through m-th circuits DE1 through DEm can sequentially increase. The delays of the first through m-th delay circuits DE1 through DEm are set below a predetermined value so that the first source line driving signal OUT1 can be output in response to the first control signal SW_1 and the inverted first control signal SW_1B.

The multiplexer MUX selects one of the switch signal SW_IN and the delayed switch signals SW_IND1 through SW_INDm in response to the first selection signal SEL1 and outputs the selected signal as a control signal SW1.

The inverter INV inverts the first control signal SW_1 and generates the inverted first control signal SW_1B.

Each of the second through n-th control circuits 232 through 23*n* includes the same or similar components as the first control circuit 231.

Figure 7:
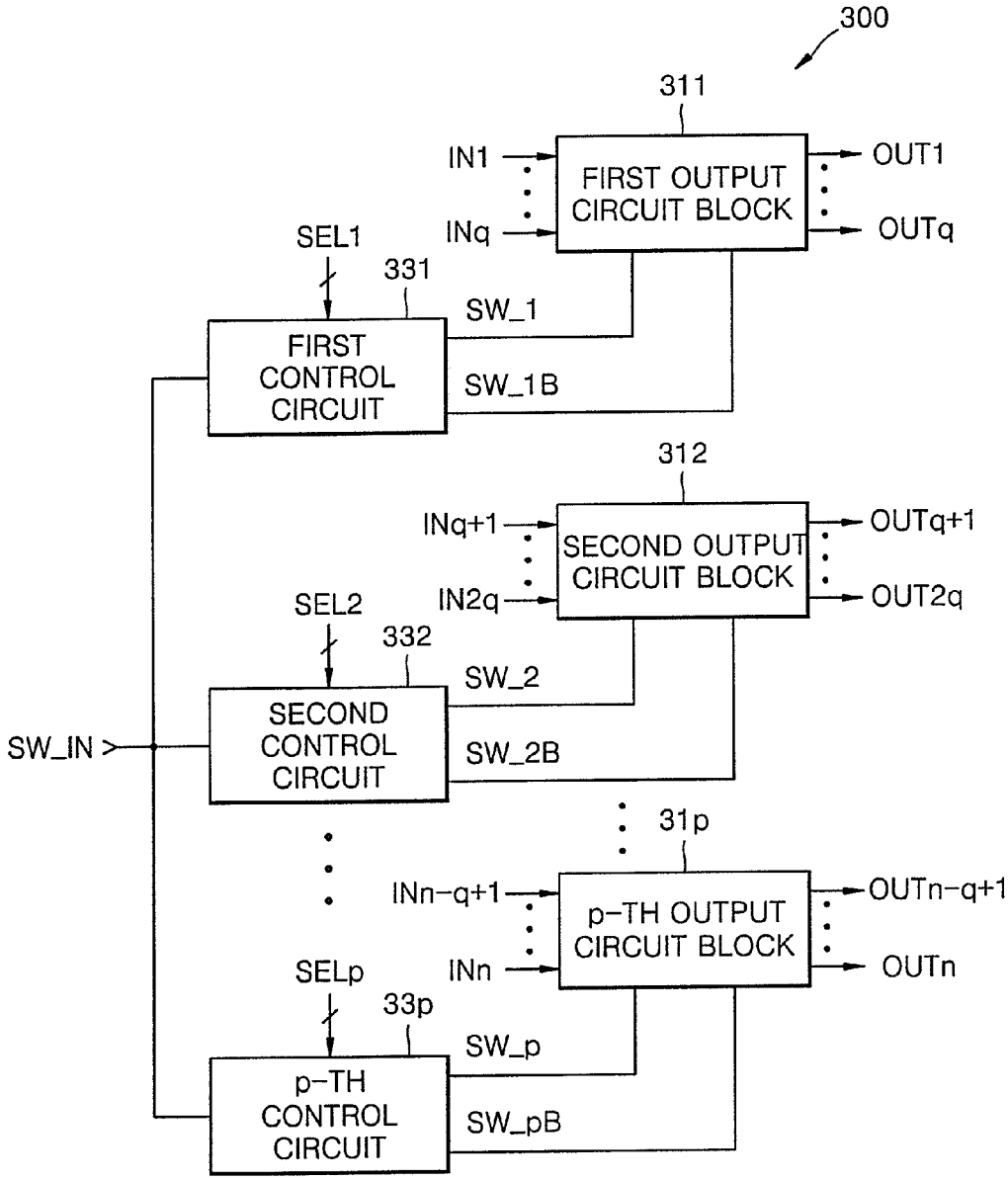
FIG. 7 is a block diagram of a source driver according to another exemplary embodiment of the present invention.

FIG. 7 is a block diagram of a source driver 300 according to another embodiment of the present invention.

Referring to FIG. 7, the source driver 300 includes first through p-th output circuit blocks 311 through 31*p* and first through p-th control circuits 331 through 33*p* for controlling the timings of the first through p-th output circuit blocks 311 through 31*p*. Each of the output circuit blocks 311 through 31*p* includes q of the output circuits 211 through 21*n* shown in FIG. 5. Here, n, p, and q are integers greater than 2, and p and q are less than n.

Each of the q output circuits included in the first output circuit block 311 includes the same or similar components as the output circuits 211 through 21*n*. The first output circuit block 311 amplifies first block analog image signals IN1 through INq and outputs the amplified block analog image signals IN1 through INq as first block source line driving signals OUT1 through OUTq in response to the activation of a first control signal SW_1 and the activation of an inverted first control signal SW_IB.

The first control circuit 331 includes the same or similar components as the first control circuit 231 shown in FIG. 6. The first control circuit 331 delays a switch signal SW_IN, generates a plurality of delayed switch signals, selects one of the switch signal SW_IN and the delayed switch signals in response to a first selection signal SEL1, and outputs the selected signal as the first control signal SW_1 and outputs the inverted first control signal SW_1B. The switch signals SW_IN are generated by the source driver 300. The first selection signal SEL1, which consists of a plurality of bits, can be received through option pins of a source driver chip or through a timing controller of a liquid crystal display device including the source driver 300.

Each of the second through p-th output circuit blocks 312 through 31*p* includes the same or similar components as the first output circuit block 311, and each of the second through p-th control circuits 332 through 33*p* for controlling the second through p-th output circuit blocks 312 through 31*p* performs the same or similar functions as the first control block 331. Accordingly, detailed descriptions of the second through p-th output circuit blocks 312 through 31*p* and the second through p-th control circuits 332 through 33*p* are omitted.

Referring to FIG. 7, input signals of the second through p-th output circuit blocks 312 through 31*p* are second through p-th block analog image signals [INq+1 through IN2*q*] through [INn-q+1 through INn], and output signals of the second through p-th output circuits 312 through 31*p* are second through p-th block source line driving signals [OUTq+1 through OUT2*q*] through [OUTn-q+1 through OUTn]. Control signals of the second through p-th control circuits 332 through 33*p* are second through p-th selection signals SEL2 through SELp, and output signals of the second through p-th control circuits 332 through 33*p* are second through p-th control signals SW_2 through SW_p and inverted control signals SW_2B through SW_pB.

According to an embodiment of the present invention, a source driver that controls the delay times of control signals for controlling switches of output circuits, thereby controlling the timings of source line driving signals is disclosed.

While the present invention has been shown and described with reference to exemplary embodiments thereof, it will be understood by those of ordinary skill in the art that various changes in form and details may be made therein without departing from the spirit and scope of the present invention as defined by the following claims.

What is claimed is:

1. A source driver of a display device comprising:

a plurality of level shifters including a first level shifter for raising a voltage level of a first digital image signal and a second level shifter for raising a voltage level of a second digital image signal;

a plurality of digital-to-analog converters including a first digital-to-analog converter for converting the first digital image signal to a first analog image signal and a second digital-to-analog converter for converting the second digital image signal to a second analog image signal;

a plurality of output circuits including a first output circuit for receiving the first analog image signal and outputting a first source line driving signal and a second output circuit for receiving the second analog image signal and outputting a second source line driving signal; and a plurality of control circuits including a first control circuit for generating a first control signal and controlling the first output circuit with the first control signal and a second control circuit for generating a second control signal and controlling the second output circuit with the second control signal, the first control circuit being configured to receive a switch signal and generate a first set of delayed switch signals by delaying the switch signal, the first control circuit being configured to select one signal among the switch signal and the first set of delayed switch signals in response to a first selection signal and output the selected signal as the first control signal, the second control circuit being configured to receive the switch signal and generate a second set of delayed switch signals by delaying the switch signal, the second control circuit being configured to select one signal among the switch signal and the second set of delayed switch signals in response to a second selection signal and output the selected signal as the second control signal.

2. The source driver of claim 1, wherein each of the plurality of control circuits includes a plurality of delay circuits for receiving the switch signal and generating the delayed switch signals by delaying the switch signal.

3. The source driver of claim 1, wherein each of the plurality of control circuits includes a multiplexer for selecting said one signal among the switch signal and the delayed switch signals.

4. The source driver of claim 1, wherein the first control circuit includes a first inverter for inverting the first control signal and generating a first inverted control signal, and the second control circuit includes a second inverter for inverting the second control signal and generating a second inverted control signal.

5. The source driver of claim 4, wherein the first control circuit controls the first output circuit with the first control signal and the first inverted control signal, and the second control circuit controls the second output circuit with the second control signal and the second inverted control signal.

6. The source driver of claim 4, wherein the first output circuit includes a first output buffer for amplifying the first analog image signal and a first switch for outputting the amplified first analog image signal as the first source line driving signal in response to the first control signal, the second output circuit includes a second output buffer for amplifying the second analog image signal and a second switch for outputting the amplified second analog image signal as the second source line driving signal in response to the second control signal.

7. The source driver of claim 6, wherein the first control signal controls the first switch, and the second control signal controls the second switch.

8. The source driver of claim 6, wherein the first switch is a first transmission gate operating in response to the first control signal and the first inverted control signal, and the second switch is a second transmission gate operating in response to the second control signal and the second inverted control signal.

9. The source driver of claim 1, wherein each of the first and the second switch signals is delayed by a time period that is less than a predetermined value.

10. The source driver of claim 1, wherein each of the first and the second selection signals comprises a plurality of bits and is received through a timing controller of the display device or through option pins of the source driver.

11. The source driver of claim 6, wherein each of the first and the second output buffers is an operational amplifier with a voltage follower structure.

12. The source driver of claim 6, wherein each of the first and the second analog image signals is an RGB data signal.

13. The source driver of claim 2, wherein each of the plurality of delay circuits delays the switch signal by a different time period to the other delay circuits so that each of the delayed switch signals has a different delay time to the other delay switch signals.

14. The source driver of claim 13, wherein the delay time of the switch signal sequentially increases from one of the plurality of delay circuits to another delay circuit.

15. The source driver of claim 14, wherein the delay time by each delay circuit is set below a predetermined value so that the first source line driving signal can be outputted in response to the first control signal and the second source line driving signal can be outputted in response to the second control signal.

16. A source driver of a display device comprising:

a plurality of level shifters including a first level shifter for raising a voltage level of a first digital image signal and a second level shifter for raising a voltage level of a second digital image signal;

a plurality of digital-to-analog converters including a first digital-to-analog converter for converting the first digital image signal to a first analog image signal and a second digital-to-analog converter for converting the second digital image signal to a second analog image signal;

a plurality of output circuits including a first output circuit for receiving the first analog image signal and outputting a first source line driving signal and a second output circuit for receiving the second analog image signal and outputting a second source line driving signal; and a plurality of control circuits including a first control circuit for generating a first control signal and controlling the first output circuit with the first control signal and a second control circuit for generating a second control signal and controlling the second output circuit with the second control signal, the first control circuit being configured to receive a switch signal and generate a first set of at least one delayed switch signals by delaying the switch signal, the first control circuit being configured to select one signal among the switch signal and the first set of at least one delayed switch signals in response to a first selection signal or select one signal among the first set of at least one delayed switch signals in response to the first selection signal and output the selected signal as the first control signal, the second control circuit being configured to receive the switch signal and generate a second set of at least one delayed switch signals by delaying the switch signal, the second control circuit being configured to select one signal among the switch signal and the second set of at least one delayed switch signals in response to a second selection signal or select one signal among the second set of at least one delayed switch signals in response to the second selection signal and output the selected signal as the second control signal.

17. A source driver of a display device comprising:

a plurality of level shifters including a first level shifter for raising a voltage level of a first digital image signal, a second level shifter for raising a voltage level of a second digital image signal, a third level shifter for raising a voltage level of a third digital image signal and a fourth level shifter, for raising a voltage level of a fourth digital image signal;

a plurality of digital-to-analog converters including a first digital-to-analog converter for converting the first digital image signal to a first analog image signal, a second digital-to-analog converter for converting the second digital image signal to a second analog image signal, a third digital-to-analog converter for converting the third digital image signal to a third analog image signal, a fourth digital-to-analog converter for converting the fourth digital image signal to a fourth analog image signal;

a first output circuit block including a first output circuit and a second output circuit, the first output circuit being configured to receive the first analog image signal from the first digital-to-analog converter and output a first source line driving signal, the second output circuit being configured to receive the second analog image signal from the second digital-to-analog converter and output a second source line driving signal;

a second output circuit block including a third output circuit and a fourth output circuit, the third output circuit being configured to receive the third analog image signal from the third digital-to-analog converter and output a third source line driving signal, the fourth output circuit being configured to receive the fourth analog image signal from the fourth digital-to-analog converter and output a fourth source line driving signal;

a first control circuit for generating a first control signal and controlling the first output circuit block with the first control signal; and a second control circuit for generating a second control signal and controlling the second output circuit block with the second control signal, wherein the first control circuit is configured to receive a switch signal and generate a first set of delayed switch signals by delaying the switch signal, to select one signal among the switch signal and the first set of delayed switch signals in response to a first selection signal and to output the selected signal as the first control signal, and the second control circuit is configured to receive the switch signal and generate a second set of delayed switch signals by delaying the switch signal, to select one signal among the switch signal and the second set of delayed switch signals in response to a second selection signal and to output the selected signal as the second control signal.

18. The source driver of claim 17, wherein the first and the second source line driving signals are outputted concurrently in response to the first control signal, and the third and the fourth source line driving signals are outputted concurrently in response to the second control signal.

19. A source driver of a display device comprising:

a plurality of level shifters including a first level shifter for raising a voltage level of a first digital image signal, a second level shifter for raising a voltage level of a second digital image signal, a third level shifter for raising a voltage level of a third digital image signal and a fourth level shifter, for raising a voltage level of a fourth digital image signal;

a plurality of digital-to-analog converters including a first digital-to-analog converter for converting the first digital image signal to a first analog image signal, a second digital-to-analog converter for converting the second digital image signal to a second analog image signal, a third digital-to-analog converter for converting the third digital image signal to a third analog image signal, a fourth digital-to-analog converter for converting the fourth digital image signal to a fourth analog image signal;

a first output circuit block including a first output circuit and a second output circuit, the first output circuit being configured to receive the first analog image signal from the first digital-to-analog converter and output a first source line driving signal, the second output circuit being configured to receive the second analog image signal from the second digital-to-analog converter and output a second source line driving signal;

a second output circuit block including a third output circuit and a fourth output circuit, the third output circuit being configured to receive the third analog image signal from the third digital-to-analog converter and output a third source line driving signal, the fourth output circuit being configured to receive the fourth analog image signal from the fourth digital-to-analog converter and output a fourth source line driving signal; and a control circuit for generating a control signal and controlling the first output circuit block with the control signal, the control circuit being configured to receive a switch signal and generate a plurality of delayed switch signals by delaying the switch signal, the control circuit being configured to select one signal among the switch signal and the plurality of delayed switch signals in response to a selection signal and output the selected signal as the control signal.

20. A method for controlling a source line driving signal in a display device, comprising:

raising voltage levels of digital image signals;

converting the digital image signals to analog image signals;

receiving the analog image signals at a plurality of output circuits;

receiving a switch signal at each of a plurality of control circuits of a source driver;

receiving a selection signal at each of the plurality of control circuits;

delaying the switch signal to generate a plurality of delayed switch signals at each of the control circuits;

selecting one signal among the switch signal and the plurality of delayed switch signals at each of the control circuits in response to the selection signal;

providing, by each of the control circuits, the selected signal as a control signal to the output circuit among the plurality of output circuits; and outputting a source line driving signal in response to the control signal by each of the plurality of output circuits.

21. The method of claim 20 further comprising amplifying the analog image signal at an output buffer of each of the plurality of output circuits.

22. The method of claim 21, wherein the amplified analog image signal is the source line driving signal.

23. The method of claim 20 further comprising inverting the control signal.

24. The method of claim 20, wherein delaying the switch signal comprising increasing sequentially from one of the plurality of delay circuits to another delay circuit.

25. A method for controlling a source line driving signal in a display device, comprising:

raising voltage levels of digital image signals;

converting the digital image signals to analog image signals;

receiving the analog image signals at a plurality of output circuits of a plurality of output circuit blocks;

receiving a switch signal at each of a plurality of control circuits of a source driver;

receiving a selection signal at each of the plurality of control circuits;

delaying the switch signal to generate a plurality of delayed switch signals at each of the control circuits;

selecting one signal among the switch signal and the plurality of delayed switch signals at each of the control circuits in response to the selection signal;

providing, by each of the control circuits, the selected signal as a control signal to the output circuit block among the plurality of output circuit blocks; and outputting a source line driving signal in response to the control signal by each output circuit of each of the plurality of output circuit blocks.

26. The method of claim 25, wherein the plurality of output circuits of each of the plurality of output circuit blocks output the source line driving signals concurrently in response to the same control signal.

27. The method of claim 25, wherein the plurality of output circuit blocks output the source line driving signals at a different time to one another with the different control signal to one another.

28. A source driver of a display device comprising:

a plurality of level shifters including a first level shifter for raising a voltage level of a first digital image signal, a second level shifter for raising a voltage level of a second digital image signal, a third level shifter for raising a voltage level of a third digital image signal and a fourth level shifter for raising a voltage level of a fourth digital image signal;

a plurality of digital-to-analog converters including a first digital-to-analog converter for converting the first digital image signal to a first analog image signal, a second digital-to-analog converter for converting the second digital image signal to a second analog image signal, a third digital-to-analog converter for converting the third digital image signal to a third analog image signal, a fourth digital-to-analog converter for converting the fourth digital image signal to a fourth analog image signal;

a first output circuit block including a first output circuit and a second output circuit, the first output circuit being configured to receive the first analog image signal from the first digital-to-analog converter and output a first source line driving signal, the second output circuit being configured to receive the second analog image signal from the second digital-to-analog converter and output a second source line driving signal;

a second output circuit block including a third output circuit and a fourth output circuit, the third output circuit being configured to receive the third analog image signal from the third digital-to-analog converter and output a third source line driving signal, the fourth output circuit being configured to receive the fourth analog image signal from the fourth digital-to-analog converter and output a fourth source line driving signal;

a first control circuit for generating a first control signal and controlling the first output circuit block with the first control signal; and a second control circuit for generating a second control signal and controlling the second output circuit block with the second control signal, the first control circuit being configured to receive a switch signal and generate a first set of delayed switch signals by delaying the switch signal, to select one signal among the switch signal and the first set of delayed switch signals in response to a first selection signal and to output the selected signal as the first control signal, the second control circuit being configured to receive the switch signal and generate a second set of delayed switch signals by delaying the switch signal, to select one signal among the switch signal and the second set of delayed switch signals in response to a second selection signal and to output the selected signal as the second control signal, wherein the first output circuit block outputs the first and the second source line driving signals at a first time period, and the second output circuit block outputs the third and the fourth source line driving signals at a second time period which is different from the first time period.

29. The source driver of claim 28, wherein the first and the second source line driving signals are outputted concurrently in response to the first control signal, and the third and the fourth source line driving signals are outputted concurrently in response to the second control signal.

* * * * *